US012296223B1

(12) United States Patent
Robinson

(10) Patent No.: US 12,296,223 B1
(45) Date of Patent: May 13, 2025

(54) LUMBAR EXERCISE MACHINE

(71) Applicant: William G. Robinson, Wayzata, MN (US)

(72) Inventor: William G. Robinson, Wayzata, MN (US)

( * ) Notice: Subject to any disclaimer, the term of this patent is extended or adjusted under 35 U.S.C. 154(b) by 428 days.

(21) Appl. No.: 17/736,572

(22) Filed: May 4, 2022

Related U.S. Application Data

(60) Provisional application No. 63/183,768, filed on May 4, 2021.

(51) Int. Cl.

| | |
|---|---|
| ***A63B 23/02*** | (2006.01) |
| ***A63B 21/00*** | (2006.01) |
| ***A63B 21/002*** | (2006.01) |
| ***A63B 23/00*** | (2006.01) |

(52) U.S. Cl.
CPC .... *A63B 23/0238* (2013.01); *A63B 21/00185* (2013.01); *A63B 21/0023* (2013.01); *A63B 21/4034* (2015.10); *A63B 21/4035* (2015.10); *A63B 21/4047* (2015.10); *A63B 2023/006* (2013.01); *A63B 2208/0228* (2013.01); *A63B 2210/50* (2013.01); *A63B 2225/09* (2013.01)

(58) Field of Classification Search
CPC ..... A63B 21/00185; A63B 21/002; A63B 21/0023; A63B 21/068; A63B 21/159; A63B 21/4033; A63B 21/4034; A63B 21/4035; A63B 21/4047; A63B 23/0233; A63B 23/0238; A63B 2023/006; A63B 2208/0228; A63B 2208/0238; A63B 2210/00; A63B 2210/50; A63B 2225/09
See application file for complete search history.

(56) References Cited

U.S. PATENT DOCUMENTS

| | | | | | |
|---|---|---|---|---|---|
| 2,209,034 | A * | 7/1940 | Paul | A63B 21/04 D21/666 |
| 3,751,033 | A * | 8/1973 | Rosenthal | A63B 22/0694 482/63 |
| 4,222,376 | A * | 9/1980 | Praprotnik | A61H 1/0214 601/24 |
| 4,262,902 | A * | 4/1981 | Dranselka | A63B 22/0605 482/63 |
| 4,538,804 | A * | 9/1985 | Zibell | A63B 22/0605 482/57 |
| 4,828,522 | A * | 5/1989 | Santos | B63B 34/565 441/132 |
| 4,838,547 | A * | 6/1989 | Sterling | A63B 23/00 482/130 |

(Continued)

FOREIGN PATENT DOCUMENTS

| | | | |
|---|---|---|---|
| CN | 203220725 U | * | 10/2013 |
| CN | 110102021 A | * | 8/2019 |
| KR | 20170114874 A | * | 10/2017 |

*Primary Examiner* — Gary D Urbiel Goldner
(74) *Attorney, Agent, or Firm* — R. John Bartz

(57) ABSTRACT

A portable exercise machine useable for isometric exercise and conditioning of the multifidus muscle has a seat with an adjustable upwardly inclined arm member and an adjustable downwardly inclined leg member. A handle connected to the arm member is adapted to be gripped by the user to perform static muscle contraction and stretching. A foot rest connected to the leg member allows the user's heels to rotate downwardly forcing the pelvis to lock and isolate the multifidus muscle for stretching and strengthening.

19 Claims, 6 Drawing Sheets

(56) References Cited

U.S. PATENT DOCUMENTS 5,108,092 A * 4/1992 Hurst ..... A63B 22/0605 482/908
5,374,229 A 12/1994 Sencil
5,409,438 A 4/1995 Jones et al.
5,421,796 A 6/1995 Jones et al.
5,484,365 A 1/1996 Jones et al.
5,575,743 A 11/1996 Jones et al.
5,575,744 A 11/1996 Jones et al.
5,580,337 A * 12/1996 Habing ..... A63B 22/0046 482/142
6,004,246 A 12/1999 Sencil
6,354,982 B1 3/2002 Sencil
6,866,618 B2 * 3/2005 Rusinak-Connors ..... A63B 22/0694 482/148
7,425,190 B2 * 9/2008 Kolarick ..... A63B 22/0605 482/111
7,695,410 B2 * 4/2010 Kim ..... A63B 23/03525 482/904
9,056,220 B2 * 6/2015 Richards ..... A63B 21/00069
9,566,469 B1 * 2/2017 Rector ..... A63B 21/028
10,130,838 B2 * 11/2018 Murrell ..... A63B 21/4027
11,000,726 B2 * 5/2021 Gonzalez ..... A63B 21/4034
11,559,721 B2 * 1/2023 Polk ..... A63B 21/225
2003/0092536 A1 * 5/2003 Romanelli ..... A61H 1/0214 482/60
2005/0101443 A1 * 5/2005 Liao ..... A61H 1/003 482/51
2006/0085903 A1 * 4/2006 Renna ..... A63B 22/0694 4/546
2006/0281610 A1 * 12/2006 Perez, Jr. ..... A63B 23/0211 482/130
2008/0076643 A1 3/2008 Sencil
2008/0124991 A1 * 5/2008 Kolarick ..... A63B 22/0005 441/129
2011/0275487 A1 * 11/2011 Richards ..... B63B 34/50 482/57
2011/0281693 A1 * 11/2011 Arstein ..... A63B 26/003 482/57
2017/0225029 A1 * 8/2017 Lin ..... A63B 21/00181
2017/0259111 A1 * 9/2017 Hsieh ..... A63B 22/0605
2017/0291062 A1 * 10/2017 Chang ..... A63B 21/4035
2018/0279793 A1 * 10/2018 Derecktor ..... A47C 9/005
2020/0085198 A1 * 3/2020 Derecktor ..... A47C 4/00
2020/0086169 A1 * 3/2020 Chuang ..... A63B 23/0205
2020/0324163 A1 * 10/2020 Berry ..... A63B 71/0619

* cited by examiner

LUMBAR EXERCISE MACHINE

CROSS REFERENCE TO RELATED APPLICATION

This application claims the priority of U.S. Application Ser. No. 63/183,768 filed May 4, 2021.

FIELD OF THE INVENTION

The technology of the invention relates to the field of exercise machines. The exercise machines provide adjustable resistance for exercise and strengthening of the lower back of the body.

BACKGROUND OF THE INVENTION

People with strong multifidus muscle typically do not experience back pain. Weak multifidus muscle is commonly associated with back pain. Research has proven that eighty percent of back pain is caused by weak multifidus muscle. The main function of this muscle is to keep the spine stable. A stable spine is a key factor in preventing the vertebrae from engaging the nerves and resulting in substantial pain. There is a need for a portable exercise device for exercising, stretching and strengthening multifidus muscle to prevent, reduce and cure back pain.

SUMMARY OF THE INVENTION

The exercise machine of the invention has an adjustable foot rest to accommodate the feet of a person seated on the machine whereby the person's legs extend generally forward with the feet supported by the foot rest and the knees bent so that the thighs and the calves form an obtuse angle. Pressure applied against the foot rest results in the lower back being forced against a back stationary pad and keeping the pelvis from moving during an exercise position. This isolates multifidus muscle from the larger muscles in the hips, buttocks and legs to enable the multifidus muscle to be exercised, stretched and strengthened without aid, participation or interference from other large muscle groups. The person then grips an adjustable handle at a desired height and proceeds with an isometric exercise posture involving static contraction of the multifidus muscle by applying pressure to the foot rest while flexing the person's torso against resistance provided by the exercise machine.

DESCRIPTION OF THE INVENTION

Figure 1:
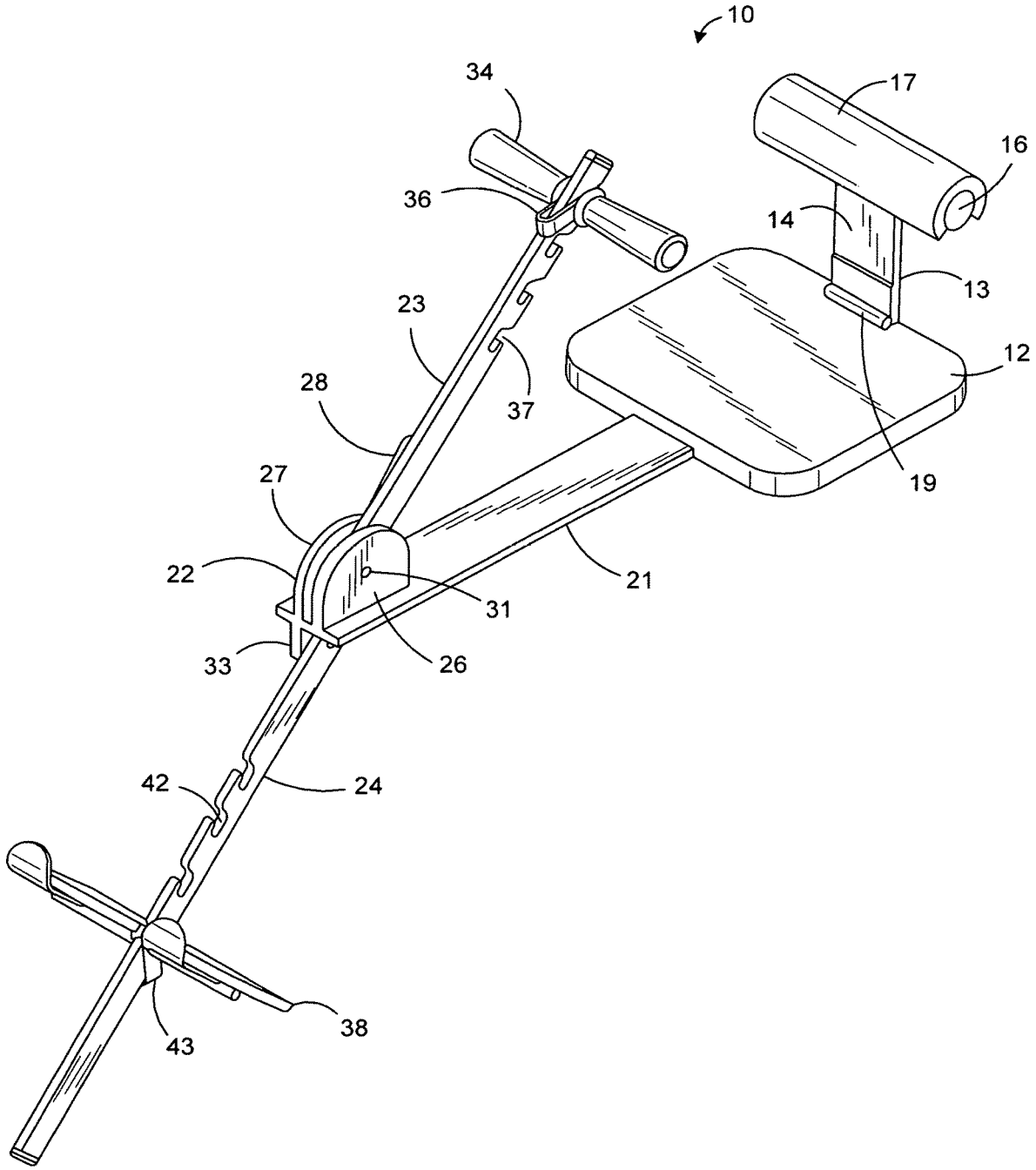
FIG. 1 is a perspective view of the exercise machine of the invention.
Figure 2:
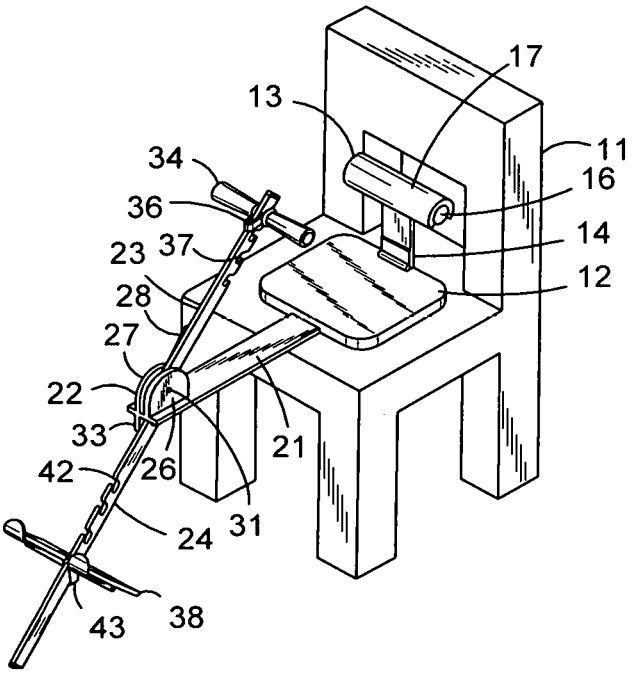
FIG. 2 is a perspective view of the exercise machine of FIG. 1 shown located on a chair.
Figure 3:
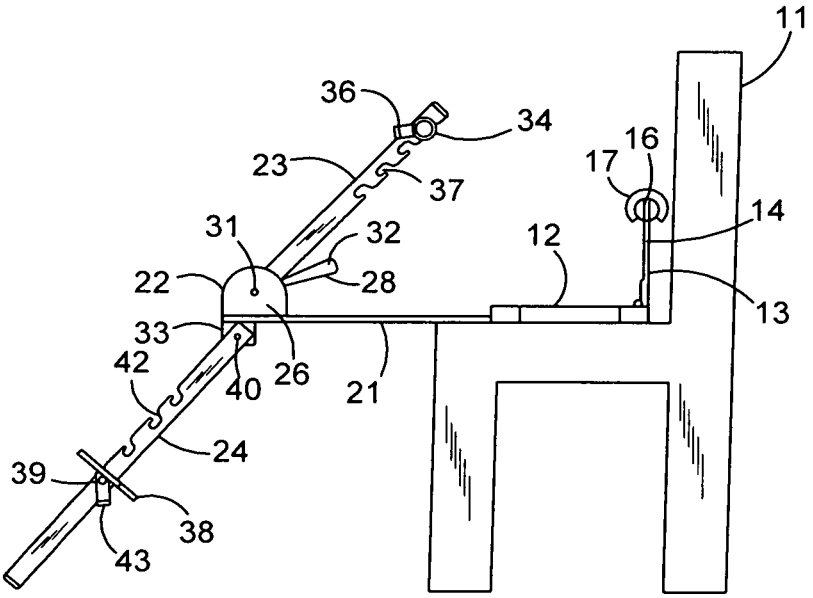
FIG. 3 is side elevational view of the exercise machine of FIG. 1 shown located on a chair.

In the following detailed descriptions of the exercise machine, reference is made to the accompanying drawing that form a part hereof, and in which are shown, by way of illustration, specific embodiments in which the invention may be practiced. It is to be understood that other embodiments may be utilized and structure changes may be made or other method steps and sequence thereof may be used without departing from the scope of the present invention. The exercise machine is herein described as used in home and business environments. The exercise machine can have uses in other environments where exercising and strengthening of the lower back of the body as desired.

Referring to FIGS. 1 to 5, there is shown a lumbar exercise machine 10 of the invention. Exercise machine 10 is useable to exercise, condition and strengthen the multifidus muscle of the low back area of the body to prevent and treat chronic low back pain. Exercise machine 10 enables a person to develop multifidus muscle tone, building strength and endurance, prevent injuries and treat debilitating lower back pain. Other muscle groups of the body can be exercised and conditioned with machine 10.

Exercise machine 10 is a self-contained portable exercise device suitable for placement and use on a bench, couch or chair 11. Exercise machine 10 has a generally flat rectangular seat 12 with an upright back support 13. Back support 13 is a T-shaped member having a downwardly extending brace 14 and a cylindrical cross member 16. Cross member 16 is a generally cylindrical member attached to the top of brace 14. A pad 17 surrounds the top and side portions of cross member 16. The lower end of back support 13 is pivotally connected to the back of seat 12 allowing support 13 to move between an open upright position to a closed folded horizontal position. A rounded tab 18 on the lower end of back support 13 accommodated by a complimentary sleeve 19 in the back of seat 12 pivotally connects support 13 to seat 12.

An elongated rectangular-shaped bar 21 extends laterally away from the central front portion of seat 12 opposite from back support 13. Bar 21 is adapted to extend between the legs of an exercise person. The outer end of bar 21 has a connector 22 for connecting an elongated flat arm member 23 in an upwardly and inclined position relative to seat 12. Arm member 23 is movable backward and forward relative to seat 12. Arm member 23 can also be locked into a selected position. A cross handle 34 releasably joined to the top portion of arm member 23 is useable to move arm member 23 and apply isometric pressure to arm member 23. Cross handle 34 has a U-shaped clip 36 and is accommodated by grooves 37 in arm member 23. Clip 36 holds handle 34 at selected positions as desired.

Connector 22 has a pair of semi-circular shaped yoke members 26 and 27 pivotally connected to the lower end of arm member 23. Yoke members 26 and 27 are laterally spaced whereby the lower end of arm member 23 is located between yoke members 26 and 27. An adjustable brake member 28 for arresting or limiting the motion of arm member 23 by means of friction is attached to yoke members 26 and 27. Brake member 28 has a rectangular shaped lower end 29 located adjacent the outer wall of yoke member 27. A fastener 31 extends from lower end 29 of brake member 28, through yoke member 27 and the lower end of arm member 23, and into yoke member 28 to adjustable connect arm member 23 to connector 22. A brake handle 32 extends upwardly from lower end 29. Brake member 28 is rotated in a clockwise direction to tighten fastener 31 and increase the resistance of backward and forward motion of arm member 23 relative to connector 22 and lock arm member 23 in various positions as desired. Moving brake member 28 in a counterclockwise opposite direction loosens fastener 31 and unlocks arm member 23 and decreases the resistance of motion of arm member 23.

Bar 21 has a downwardly extending linkage 33 located opposite yoke members 26 and 27 for adjustably connecting leg member 24 to bar 21 opposite arm member 23. A fastener 43 extending through linkage 33 and the upper end of leg member 24 is tightened to hold leg member 24 in selected downwardly and outwardly inclined positions relative to seat 12. A foot rest or plate 38 releasably joined to the bottom portion of leg member 24 is useable to accommodate the feet of a person seated on seat 12. Foot plate 38 has a rod 39 located in a groove 41 extending inwardly from the back of foot plate 38. Rod 39 is accommodated by notches 42 in leg member 24. A U-shaped clip 43 holds plate 38 at selected positions as desired whereby the person's legs extend generally forward with the person's feet supported by the foot plate 38 and the person's knees bent so that the thighs and the calves of the person form an obtuse angle when the person is seated on seat 12.

In use, a person seated on seat 12 of exercise machine 10 grips cross handle 34 and proceeds to perform isometric exercise statically contracting the multifidus muscle for a desired period of time by pushing and pulling arm member 23 while gripping handle 34 against resistance provided by brake member 28. Pressure applied against foot plate 38 results in the lower back of the person's body being forced against back support 13 and prevents the pelvis of the person from moving during the static exercise contractions. This allows exercise, stretching and strengthening of the multifidus muscle without involving hamstring muscles, gluteus muscles and other large muscle groups of the lower back.

Figure 4:
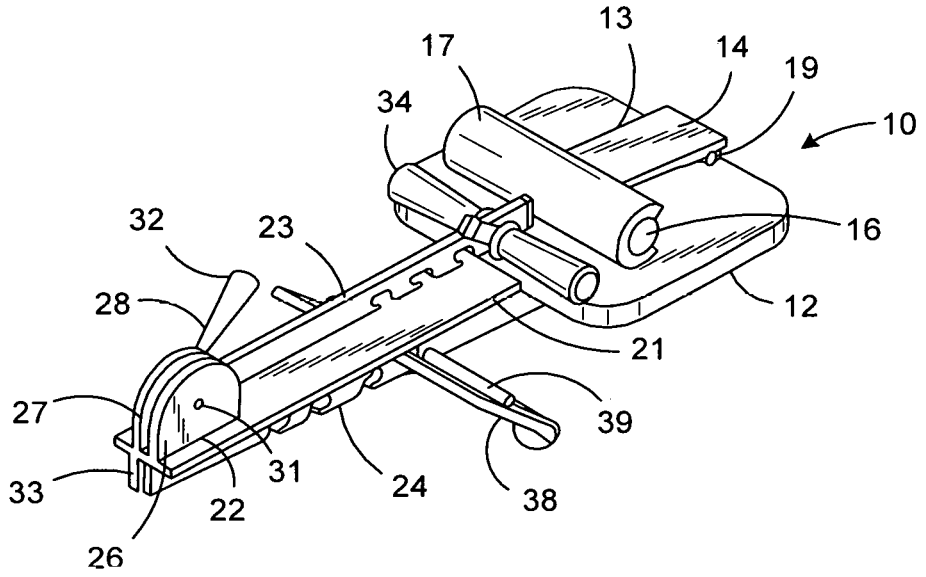
FIG. 4 is a perspective view of the exercise machine of FIG. 1 shown in the closed folded position.
Figure 5:
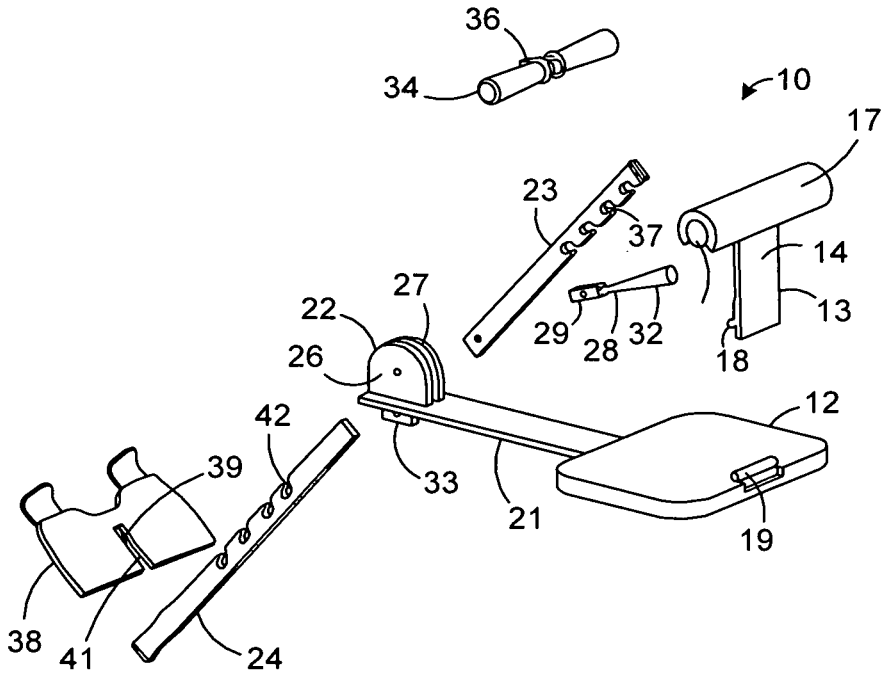
FIG. 5 is an exploded perspective view of the exercise machine of FIG. 1.

Referring to FIG. 4, to store and transport exercise machine 10, back support 13 is pivoted downwardly adjacent the top of seat 12. Fastener 31 is loosened to allow arm member 23 to pivot adjacent the top of seat 12 forwardly of back support 13. Fastener 43 is loosened to allow leg member 24 to pivot adjacent the bottom of seat 12.

Figure 6:
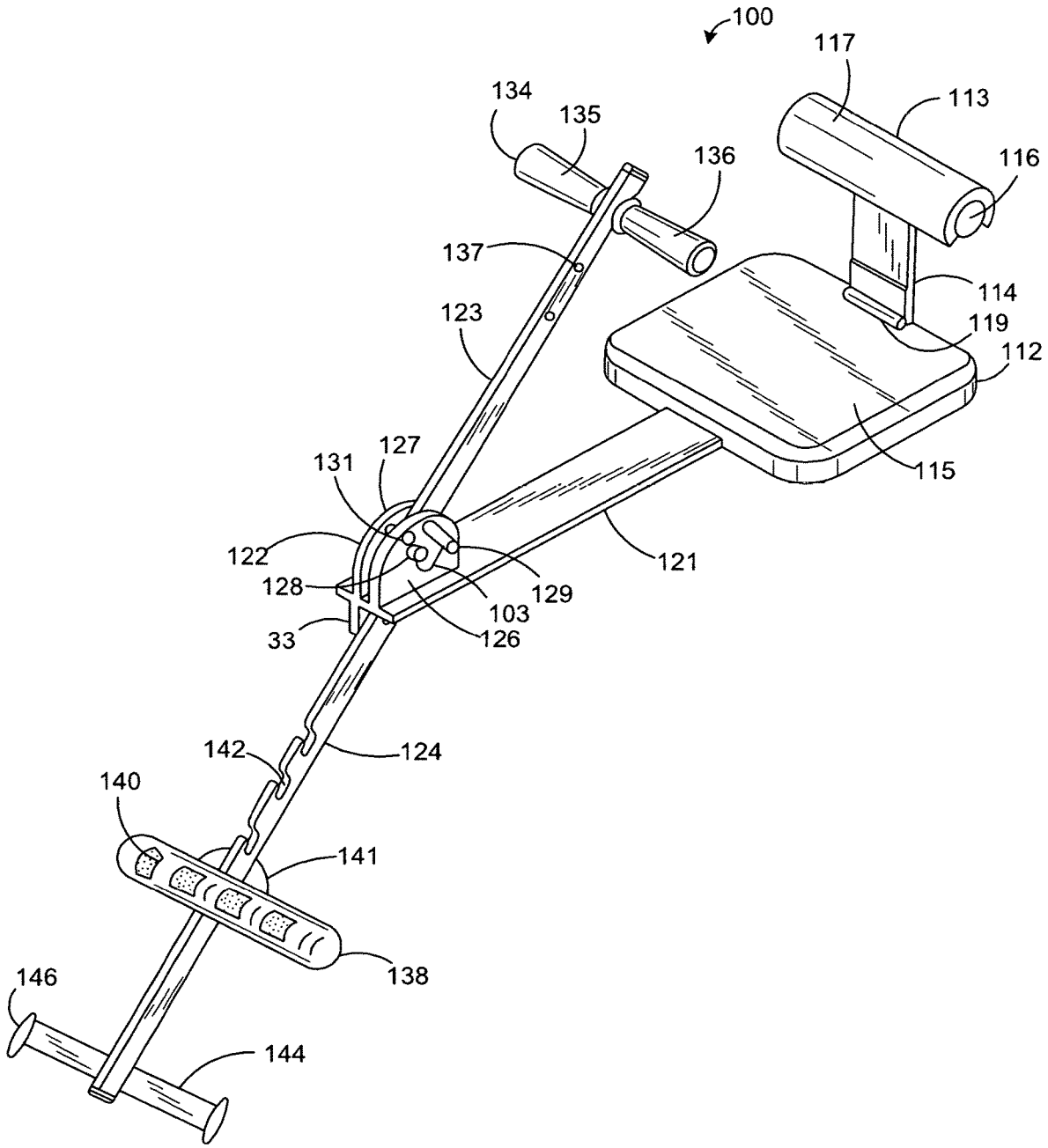
FIG. 6 is a perspective view of the exercise machine of FIG. 1.
Figure 7:
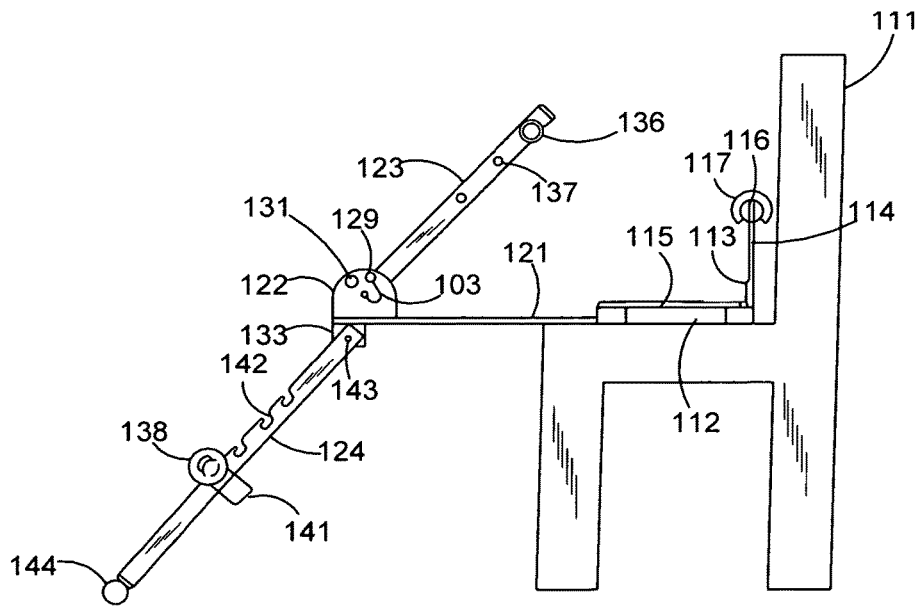
FIG. 7 is a side elevational view of the exercise machine of FIG. 6 shown located on a chair.
Figure 8:
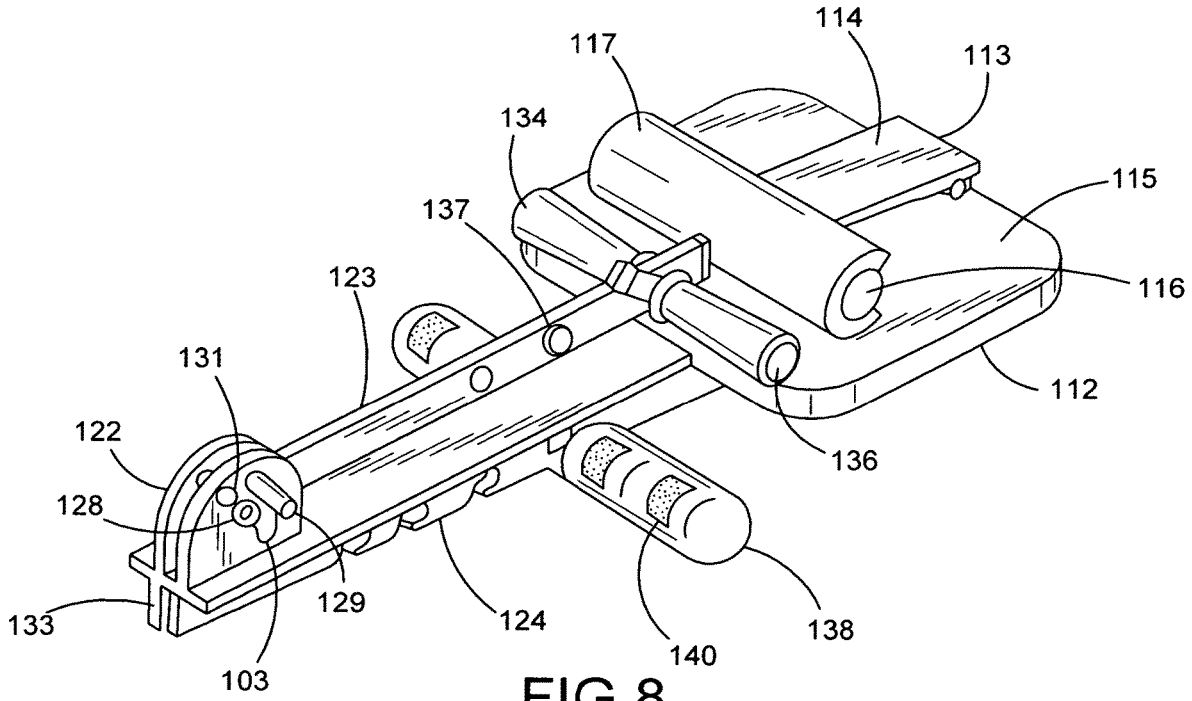
FIG. 8 is a perspective view of the exercise machine of FIG. 1 shown in the closed folded position.
Figure 9:
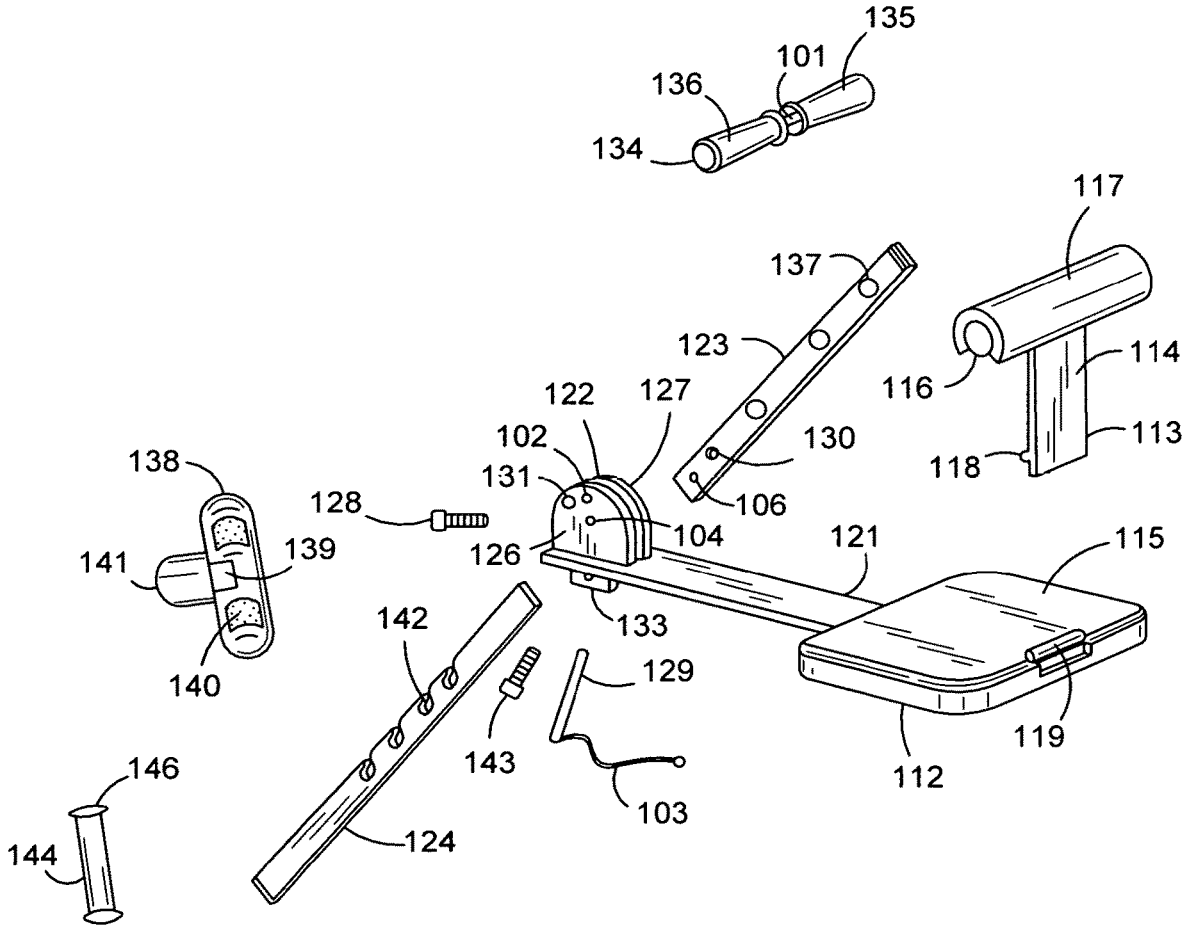
FIG. 9 is an exploded perspective view of the exercise machine of FIG. 6.

Referring to FIGS. 6 to 9, there is shown a lumbar exercise machine, indicated generally at 100, useable to exercise, condition and strengthen the multifidus muscle of the lower back area of the body. Exercise machine 100 is a portable device suitable from placement and use for exercising and stretching on a chair 111. Exercise machine 100 has a generally rectangular shaped seat 112 with an upright back support 113. A foam seat cushion 115 is attached to the top of seat 112. Back support 113 is a T-shaped member having a downwardly extending brace 114 and a cross member 116. Cross member 116 is a laterally extending cylindrical member attached to the top of brace 114. A semi-circular foam pad 117 surrounds the top and side portions of cross member 116. The lower end of back support 113 is pivotally connected to the back portion of seat 112 whereby support 113 is moveable between an open upright position, as shown in FIG. 6, and a closed folded position, as shown in FIG. 8. A rounded tab member 118 located on the lower end of back support 113, as seen in FIG. 9, is accommodated by a complimentary shaped sleeve 119 extending from the back of seat 112 to pivotally connect the lower end of support 113 to the rear portion of seat 112.

An elongated rectangular shaped generally flat bar 121 extends laterally away from the front of seat 112. Bar 121 is adapted to extend between an exercise person's legs. The outer end of bar 121 has a connector 122 for connecting an elongated flat arm member 123 to the outer end of bar 121 in an upwardly and inwardly inclined position. A handle 134 is releasably connected to a top portion of arm member 123. Handle 134 has a first handle section 135 having a bolt 101 that extends through an opening 137 in arm member 123 and threads into second handle section 136 to connect handle 134 to arm member 123. The position of handle 134 on arm member 123 can be adjusted as desired by moving first handle section 135 and second handle section 136 to an adjacent opening 137 in arm member 123.

Connector 122 has a pair of semi-circular shaped yoke members 126 and 127 pivotally connected to the lower end of arm member 123. Yoke members 126 and 127 are laterally spaced from each other to accommodate the lower end of arm member 123. A fastener 128 extends through openings 104 in yoke members 126 and 127 and an opening 106 in the lower end of arm member 123 to pivotally connect arm member 123 to connector 122. A pin 129 extends through openings 102 in yoke members 126 and 127 and opening 130 in arm member 123 to hold arm member 123 in an upright open exercise position. Yoke members 126 and 127 has additional openings 131 to accommodate pin 129 whereby the upright open exercise position of arm member 123 is adjustable. Pin 129 is removable to allow arm member 123 to move between the upright open position and a folded closed position adjacent bar 121. A tether 103 attached to the end of pin 129 is secured to connector 122 with fastener 128 to attach pin 129 to connector 122.

Bar 121 has a downwardly extending linkage 133 located opposite connector 122. Leg member 124 is pivotally connected to bar 121 with a fastener 143 opposite arm member 123. Fastener 143 extends through linkage 133 and the upper end of leg member 124 and is tightened to adjustably hold leg member 124 in selected downwardly and outwardly inclined positions relative to seat 112. A foot rest 138 releasably joined to leg member 124 is useable to accommodate the feet of a person seated on seat 112 in an exercise position. Foot rest 138 is a rounded cylindrical member having a top curved outer surface 140. Top curved outer surface 140 is preferably coated with gripping material. Foot rest 138 has a slotted middle portion 139 accommodated by notches 142 in leg member 124. Foot rest 138 is adjustable on leg member 124 by placing slotted middle portion 139 in notches 142 as desired. Preferably, foot rest 138 is adjusted whereby the person's legs extend generally forward with the person's feet supported by foot rest 138 and the person's knees bent so that the thighs and calves of the person form an obtuse angle when the person is seated on seat 112 in an exercise position. A U-shaped retainer ring 141 attached to foot rest 138 adjacent slotted middle portion 139 holds foot rest on leg member 124. A transverse base member 144 is joined to the bottom of leg member 124. Base member 144 has a pair of round or disc shaped outer feet 146 engageable with the surface of an exercise area to support exercise machine 100 on the surface.

Referring to FIG. 8, to store and transport exercise machine 100, back support 113 is pivoted downwardly adjacent the top of seat 112. Pin 129 is removed from connector 122 and arm member 123 to allow arm member 123 to pivot adjacent the top of seat forwardly of back support 113. Pin 129 is then reinserted through openings 102 in connector yokes 126 and 127 to hold arm member 123 in the closed folded horizontal position. Fastener 143 is loosened to allow leg member 124 to pivot adjacent the bottom of seat 112. Fastener 143 is then tightened to hold leg member in the closed folded position.

In use, a person seated on seat 112 of exercise machine 100 grips cross handle 134 and proceeds to apply isometric sustained pressure by flexing, pushing and pulling while gripping handle 134 and engaging and pushing down on foot rest 138 for a desired period of time, such as seven to ten seconds, and for a desired number of sets, such as three sets. Pin 129 extending through connector 122 and the lower end of arm member 123 locks the position of arm member 123 in a selected upright open exercise position. Pressure applied against the rounded outer surface 140 of foot rest 138 allows the person's heel to rotate slightly downwardly resulting in the lower back of the body being forced against back support 113 and prevents the pelvis from moving during exercise flexes and contractions. This allows isometric exercise, stretching, conditioning and strengthening of the multifidus muscle without involving hamstring muscles, gluteus muscles and other large muscle groups of the lower back.

The exercise machine illustrated and described includes several embodiments of the invention. Variations and modifications of the exercise machine and exercise machine materials can be made by a person skilled in the art without departing from the invention.

The invention claimed is:

1. An exercise machine comprising:

a seat adapted to be located on an elevated support surface, a back support attached to the seat, a bar attached to the seat opposite from the back support, an arm member connected to the bar, a handle joined to the arm member, a leg member connected to the bar adjacent to the arm member, and a foot rest joined to the leg member to support feet of a person seated on the seat in an exercise position, the arm member and the leg member being pivotally connected to the bar whereby the arm member and the leg member are moveable between an open exercise position and a closed folded position.

2. The exercise machine of claim 1 including:

a base member attached to the leg member opposite from the bar, the base member engageable with a support surface.

3. The exercise machine of claim 1 wherein:

the back support is pivotally connected to the seat.

4. The exercise machine of claim 1 wherein:

the arm member extends inwardly toward and upwardly from the seat, the leg member extending outwardly and downwardly away from the seat.

5. The exercise machine of claim 1 wherein:

the handle is releasably connected to the arm member to allow adjustment of a position of the handle.

6. The exercise machine of claim 1 wherein:

the foot rest is a generally cylindrical member having a rounded outer surface.

7. The exercise machine of claim 1 wherein:

the foot rest is releasably connected to the leg member to allow adjustment of a position of the foot rest.

8. A portable exercise machine for isometric exercise of multifidus muscle, the portable exercise machine comprising:

a seat being horizontal and adapted to be located on an elevated support surface, an upright back support attached to a back portion the seat, a bar attached to the seat opposite from the upright back support, the bar extending from a front central portion of the seat, an arm member connected to the bar, the arm member extending inwardly toward and upwardly from the seat, a handle joined to an outer end of the arm member, a leg member connected to the bar adjacent to the arm member, the leg member extending outwardly and downwardly away from the seat, and a foot rest joined to the leg member to support feet of a person seated on the seat in an exercise position.

9. The portable exercise machine of claim 8 including:

a base member attached to the leg member opposite from the bar, the base member engageable with a support surface.

10. The portable exercise machine of claim 8 wherein:

the upright back support is pivotally connected to the seat.

11. The portable exercise machine of claim 8 wherein:

the handle is releasably connected to the arm member to allow adjustment of a position of the handle.

12. The portable exercise machine of claim 8 wherein:

the arm member and the leg member are pivotally connected to the bar whereby the arm member and the leg member are moveable between an open exercise position and a closed folded position.

13. The portable exercise machine of claim 8 wherein:

the foot rest is a generally cylindrical member having a rounded outer surface.

14. The portable exercise machine of claim 8 wherein:

the foot rest is releasably connected to the leg member to allow adjustment of a position of the foot rest.

15. A method of exercising, conditioning and strengthening multifidus muscle of the human body using an exercise machine having a seat, an outwardly extending bar attached to the seat, an arm member and a leg member attached to the bar opposite from the seat, a handle attached to the arm member and a foot rest attached to the leg member, the method comprising:

locating the seat on an elevated support surface, locating the handle in a selected elevated position above and outwardly from the seat, locking the arm member in a selected upwardly and inwardly inclined position to hold the handle in the selected elevated position, locating the foot rest in a selected lowered position below and outwardly from the seat to accommodate feet of a person seated on the seat whereby legs of the person extend generally forward and knees of the person bend so that thighs and calves of the person form an obtuse angle, locking the leg member to hold the foot rest in the selected lowered position, exerting pressure on the handle and the foot rest to statically contract the multifidus muscle without movement of legs and torso of the person, and maintaining the pressure on the handle and the foot rest for a selected period of time.

16. The method of claim 15 including:

rounding an outer surface of the foot rest to allow heels of the person to rotate downwardly when applying pressure to the rounded outer surface.

17. The method of claim 15 including:

releasably connecting the handle to the arm member to allow adjustment of the selected elevated position.

18. The method of claim 15 including:

releasably connecting the foot rest to the leg member to allow adjustment of the selected lower position of the foot rest.

19. The method of claim 15 including:

pivotally connecting the arm member and the leg member to the bar whereby the arm member and the leg member are moveable between an open exercise position and a closed folded position.

* * * * *